United States Patent [19]

Derrick, Jr.

[11] 4,085,776

[45] Apr. 25, 1978

[54] FLOW DIVIDER

[75] Inventor: H. William Derrick, Jr., Williamsville, N.Y.

[73] Assignee: Derrick Manufacturing Corporation, Buffalo, N.Y.

[21] Appl. No.: 653,364

[22] Filed: Jan. 29, 1976

[51] Int. Cl.[2] ..... F15D 1/14

[52] U.S. Cl. ..... 137/561 A

[58] Field of Search ..... 137/561 R, 561 A

[56] References Cited

U.S. PATENT DOCUMENTS

| | | | |
|---|---|---|---|
| 2,084,755 | 6/1937 | Young, Jr. | 137/561 A |
| 3,181,562 | 5/1965 | Kofink | 137/561 R |

*Primary Examiner*—William R. Cline

*Attorney, Agent, or Firm*—Christel & Bean

[57] ABSTRACT

A flow divider of the type here involved consists of a cylindrical tank having a tangential inlet near the top and a plurality of tangential outlets near the bottom. The tangential inlet produces a swirling or cyclonic action but solid material entrained or suspended in the liquid does not remain uniformly distributed in the liquid and thus the several outlets do not contain uniform quantities of solid material. The present disclosure provides an annular internal flange between the inlet and outlet passages which produces turbulence in the liquid adjacent to the wall of the tank which results in uniform solid material concentrations at the several outlets.

7 Claims, 5 Drawing Figures

FLOW DIVIDER

BACKGROUND OF THE INVENTION

This invention relates to a flow divider and more particularly to apparatus for receiving liquid having solid material suspended or entrained therein and for discharging the liquid into plural passages for delivery from the apparatus through a plurality of discharge passages.

An example of the field of use of the present apparatus is in feeding liquid suspensions or slurries to screening equipment where it is desired to discharge the liquid material at several locations along a vibrating screen or on more than one screen or both. Conventional flow dividers, known in the art as "splitters", comprise circular tanks wherein the liquid or slurry is introduced tangentially in the upper portion of the tank and undergoes a cyclonic mixing as it descends along the circular wall of the tank.

In such splitters the liquid level in the tank is above the tangential inlet passage so that the inlet flow tends to blend into the body of liquid in the tank in a cyclonic mixing action. In this type of splitter or flow divider a number of tangential discharge passages are disposed in a common horizontal plane near the bottom of the tank or at least below the tangential inlet passage.

With conventional splitters or flow dividers of the foregoing type, even though equal quantities of liquid discharge from the several discharge passages, it appears that the first discharge passage encountered by the swirling liquid suspension or slurry receives liquid containing the highest percentage of solid material while the last discharge passage in series receives liquid containing the least percentage of solid material.

This may be due to a centrifugal separation action which takes place during the cyclonic swirling of the material between the inlet passage and the several discharge passages. Whatever the reason, in such apparatus I have found that the first discharge passage contains a greater quantity of solid material with the quantity of solid material diminishing progressively to the last in the series of discharge passages. This of course results in the solid material being dispensed in unequal quantities from the several discharge passages.

In the case where the material is being discharged to several points on a vibrating screen or to several vibrating screens, or both, the solid material to be screened is not uniformly distributed on the screen or screens with an obvious inefficiency of operation. Similar objections would arise when the material is being divided up by the flow divider for other purposes.

SUMMARY OF THE INVENTION

According to the present invention it is found that interposing an annular flange or ledge against the internal wall of the tank at a level below the inlet passage and above the discharge passages forces the liquid which is closest to the wall of the tank to move radially inwardly and the flange or ledge thus produces a turbulence and a mixing action in the outer regions of the body of liquid in the tank. This mixing occurs uniformly throughout the internal circumference of the tank and results in the liquid discharging through the several circumferentially spaced outlet passages being of highly uniform concentration as to content of solid material per volume of liquid.

DESCRIPTION OF THE ILLUSTRATED EMBODIMENT

Figure 1:
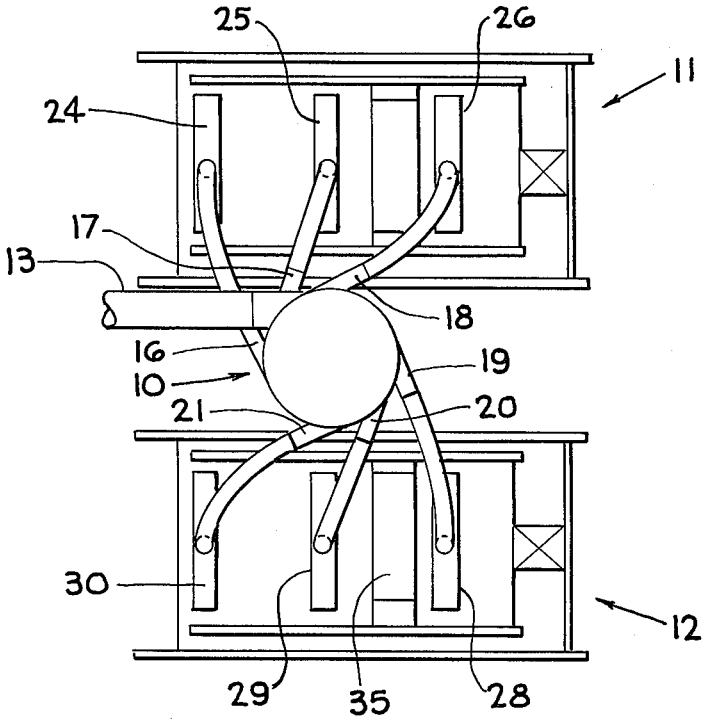
FIG. 1 is a general top plan view of one form of the apparatus of the present invention in which the flow divider is supplying two vibrating screen structures.
Figure 2:
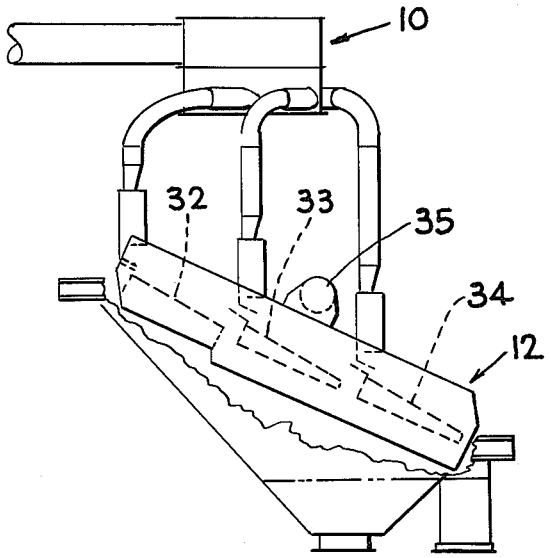
FIG. 2 is a side elevational view of the apparatus of FIG. 1.

Referring first to FIGS. 1 and 2 the numeral 10 designates generally a flow divider according to the present invention and the numerals 11 and 12 designate generally a pair of vibrating screen devices. A liquid or slurry containing solid material which is to be screen is introduced to the flow divider 10 by way of a conduit 13 and in the present embodiment flow divider 10 is provided with six discharge conduits designated 16 through 21.

The discharge conduits 16, 17 and 18 lead to screen 11 and discharge, respectively, into distributing boxes 24, 25 and 26. The distributing boxes spread the material issuing from the flow divider discharge conduits laterally with respect to the screen structures to deposit the same evenly on the screen surfaces and also serve to reduce the velocity of the material as it is deposited upon the screen surfaces.

Similarly, discharge conduits 19, 20 and 21 discharge respectively into distributing boxes 28, 29 and 30 of the screening devices 12. As appears from FIG. 2, the screen structures in the present instance each contain three screen surfaces which in the case of screen 12 are designated 32, 33 and 34. Of course the flow dividing means of the present invention may be employed with equal efficacy in the case of a single continuous screen surface.

In FIG. 2 the numeral 35 designates the means for vibrating the screen frame. It is to be understood that the screen structures are known in this art and are shown and described here merely in general terms and to assist in any understanding of the functioning of the flow divider which forms the subject of the invention.

Figure 3:
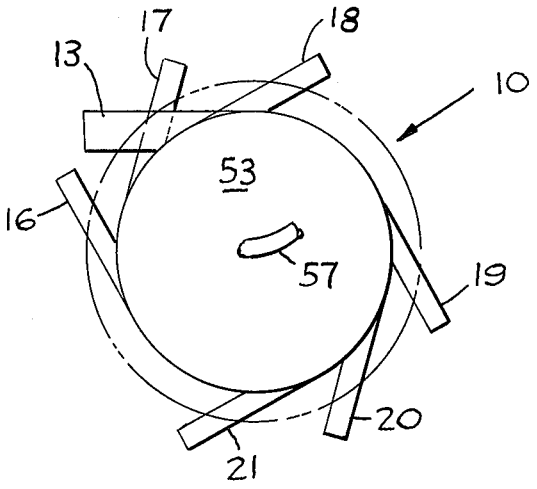
FIG. 3 is a top plan view of the flow divider of FIGS. 1 and 2.
Figure 5:
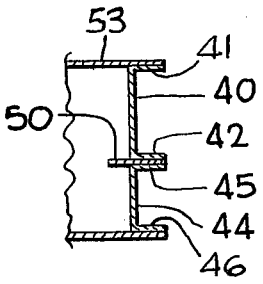
FIG. 5 is a fragmentary cross-sectional view through the flow divider of FIGS. 3 and 4 taken on a vertical plane.

FIG. 3 is a detailed top plan view of the flow divider 10 showing the entry duct 13 and the series of discharge passages 16 through 21. In the form shown herein by way of example the flow divider 10 consists of an upper hollow cylindrical member 40 having top and bottom marginal flanges 41 and 42 and a lower hollow cylindrical member 44 having top and bottom marginal flanges 45 and 46. As shown in FIG. 5 an annular plate 50 is disposed between the flanges 42 and 45 of cylindrical sections 40 and 44 and its inner marginal portion projects into the cylindrical interior of the flow divider.

Speaking in general terms, with flow divider drums of from 18 to 24 inches inside diameters, when annular plate 50 projects into the interior of the drum chamber a distance of about one inch excellent results are attained with average liquid mixtures and under normal conditions.

Figure 4:
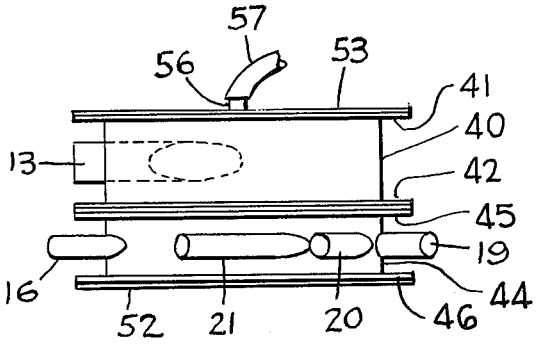
FIG. 4 is a side elevational view thereof.

In FIGS. 4 and 5 the numeral 52 designates a discoidal bottom plate which is attached to flange 46 of cylindrical member 44 and the numeral 53 designates a removable top cover member. The latter is preferably of acrylic resin or other transparent material so that the action within the flow divider may readily be observed.

It is essential to proper operation of the present flow divider that the tank be filled with liquid during flow dividing operation and to this end a vent nipple 56 is disposed centrally of the top plate 53 of the tank to permit egress of air from the tank and thus insure that the tank is filled with liquid. As indicated in FIGS. 3 and 4 the nipple 56 may be provided with a hose 57 which may discharge into one of the feed boxes 24 through 30 to recover liquid which may incidentally discharge from the nipple 56 or such discharge may be dealt with in any other convenient or desired manner.

As indicated earlier herein, the use of the flow divider of the present invention is not limited to screening operations but may be employed wherever or whenever equal division of a flow of liquid is required.

A preferred embodiment of the present invention has been described herein and shown in the accompanying drawings to illustrate the underlying principles of the invention but it is to be understood that numerous modifications may be made without departing from the broad spirit and scope of the invention.

I claim:

1. A flow divider for separating a stream of liquid having particles of solid material entrained or suspended therein into a plurality of streams having substantially uniform concentrations of solid particles therein, said flow divider comprising a cylindrical tank having an inlet passage for said liquid disposed at an upper portion of said tank and entering the same tangentially, a plurality of discharge passages at a lower portion of said tank and arranged to leave the tank tangentially in the direction of circular flow of said liquid in said tank, and an annular flange extending horizontally about the interior of the tank and extending radially inwardly from the wall thereof above and in proximity said outlet passages to cause the peripheral portions of the liquid and solids to flow radially inwardly whereby such portions are carried downwardly into more central portions of the liquid substantially at the level of the discharge passages and are admixed therewith in the radially outward flow of such more central portions to the discharge passages.

2. A flow divider according to claim 1 wherein the several discharge passages are spaced substantially uniformly about said tank.

3. A flow divider according to claim 2 wherein the several discharge passages are disposed substantially in a common horizontal plane.

4. A flow divider according to claim 1 wherein the several discharge passages are disposed substantially in a common horizontal plane.

5. A flow divider according to claim 1 wherein the several discharge passages are of uniform cross-sectional area.

6. A flow divider according to claim 1 wherein said tank comprises a closed chamber having a central vent passage in the upper end thereof.

7. A flow divider according to claim 1 having a top wall having a central vent passage extending upwardly therethrough.

* * * * *